United States Patent [19]

Kallinger

[11] 4,238,115

[45] Dec. 9, 1980

[54] JACKING DEVICE

[75] Inventor: Franz Kallinger, Greenwich, Conn.

[73] Assignee: Research-Cottrell, Inc., Chicago, Ill.

[21] Appl. No.: 67,534

[22] Filed: Aug. 17, 1979

[51] Int. Cl.[3] ..... B66F 1/00

[52] U.S. Cl. ..... 254/106

[58] Field of Search ..... 254/105-107, 254/89 R, 89 H

[56] References Cited

U.S. PATENT DOCUMENTS

| | | | |
|---|---|---|---|
| 3,028,143 | 9/1962 | Cheskin | 254/105 |
| 3,036,816 | 5/1962 | Stubbs et al. | 254/105 |
| 3,895,778 | 7/1975 | Ahlgren | 254/106 |

*Primary Examiner*—Robert C. Watson

*Attorney, Agent, or Firm*—Wegner, Stellman, McCord, Wiles & Wood

[57] ABSTRACT

A jacking device for use with a thread bar having a plurality of couplers and nuts spaced longitudinally thereon. The jacking device is arranged to permit movement thereof longitudinally past the respective couplers and nuts while permitting utilization of the nuts by threaded movement thereof on the thread bar for supporting different portions of the jacking device relative to the thread bar in effecting the desired jacking operation. The jacking device may be utilized to climb the thread bar and, alternatively, may be utilized to pull the thread bar and lift a load associated therewith. The jacking device includes biased chuck elements movably carried to permit passing of the couplers and nuts and selective support thereof on the nuts in effecting the controlled jacking operation.

14 Claims, 5 Drawing Figures

JACKING DEVICE

TECHNICAL FIELD

This invention relates to jacking devices and in particular to jacking devices for lifting loads such as in construction of large structures, such as buildings, chimneys, and the like.

BACKGROUND ART

In one known form of jacking system for use with thread bars, a pair of yoke frames is connected by a ram system for selectively moving the yoke frames toward and from each other in the jacking operation. Each of the yoke frames carries a cup plate and a rocker plate. When the thread bar and jacking device are moved relatively so that a nut or coupler on the thread bar is encountered, the cup plate and rocker plate must be removed by hand from the yoke frame encountering the nut or coupler. After the jacking device clears the nut or coupler, the cup plate and rocker plate are reinstalled.

While the prior art structure may be utilized to pull the thread bar with an attached load, the device is not adapted for use in hoisting the load by climing the thread bar. Further, the difficulty and expense of continuously removing and installing the cup plates and rocker plates makes the discussed prior art structure an unsatisfactory means for effecting such jacking of loads.

DISCLOSURE OF INVENTION

The present invention comprehends an improved jacking device which eliminates the undesirable features of the prior art structures in a novel and simple manner.

More specifically, the present invention comprehends the provision of an improved jacking device for raising a load relative to a vertical thread bar or the like, having longitudinally spaced nuts and couplers.

More specifically, the invention comprehends the provision of such a jacking device having new and improved means for effecting selective movement of the thread bar coupling means on the jacking device so as to permit the coupling means to be spaced apart to permit relative movement between the jacking device and nuts and couplers on the thread bar when desired.

The coupling means may comprise chucks which may be spring-biased to engage the thread bar.

The chucks may have camming surfaces for engagement by the nuts and connectors on the thread bar to effect an automatic movement of the chucks against the biasing means to permit the desired passing of the nuts and connectors in the jacking operation.

The biasing means may comprise spring means connected between the movable chucks for urging them toward the thread bar and spring means connected between the chucks and the frame supports for similarly biasing the chucks.

The jacking operation may include the steps of manually turning the lift nuts into supporting relationship to the chucks after the chucks are brought to a superjacent position.

The jacking device of the present invention is extremely simple and economical of construction while yet providing the highly desirable features and substantial improvement over the prior art structures as discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
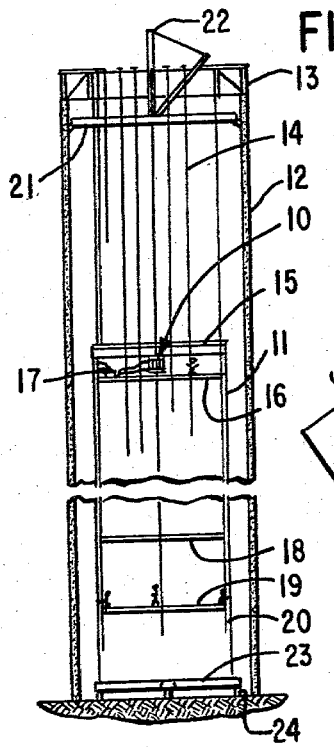
FIG. 1 is a side elevation of a construction arrangement utilizing a jacking device embodying the invention.

In the illustrative embodiment of the invention as disclosed in the drawing, a jacking device generally designated 10 is shown for use in lifting a load, such as a steel liner 11, being constructed within a chimney shell 12. As shown in FIG. 1, a box girder 13 may be installed on the top of the previously erected chimney shell 12 for supporting a plurality of depending thread bars 14. A lift ring 15 is connected to the liner 11 and is adapted to be lifted by a plurality of jacking devices 10 provided one each on the respective downwardly extending thread bars. As shown in FIG. 1, a work scaffold 16 may be carried also by the lift ring for defining a platform on which workers may be positioned in operating the jacking devices, as will be brought out more fully hereinafter. Hydraulic pump means 17 may also be carried on the scaffold 16 for use in operating the jacking devices.

A fixed weld scaffold 18 and a fixed fit-up scaffold 19 may be provided on suitable jack rods 20, also depending from the jack rod supports on the box girder 13, as shown in FIG. 1. Still further, a removable platform 21 may be mounted to the shell 12 adjacent the upper end thereof for carrying a box girder erection boom 22, or the like.

A conventional fit-up jig template frame 23 may be carried on suitable template-raising jacks 24 at the base of the liner.

As indicated briefly above, jacking devices 10 are advantageously adapted for use selectively in climbing the respective thread bars so as to lift the load by the upward movement of the lift ring. Alternatively, the jacking devices may be fixedly secured as at the top of the shell 12 and the thread bars caused to move upwardly therethrough in effecting the lifting of the load carried on the lift ring. In either of these modes of operation, jacking devices 10 avoid interference with the jacking operation by the nuts 23 and connectors 24 on the thread bars. More specifically, it is conventional in the use of such thread bars to use relatively short lengths thereof interconnected by means of connectors 24 in defining the desired overall length of the thread bar. In addition, the threaded nuts 33 are spaced along the thread bar and conventionally, two such nuts are provided between each pair of connectors 34. In order for the jacking device to move upwardly along the thread bar, it must, of necessity, clear the connectors 24 and nuts 23 whenever they are encountered during such ascension. The present invention comprehends an improved, simplified structure for permitting facilitated passing of the couplers and nuts while further permitting facilitated adjustment of the nuts to define the means for supporting the different portions of the jacking device which must be supported at different stages in the jacking operation.

Figure 3:
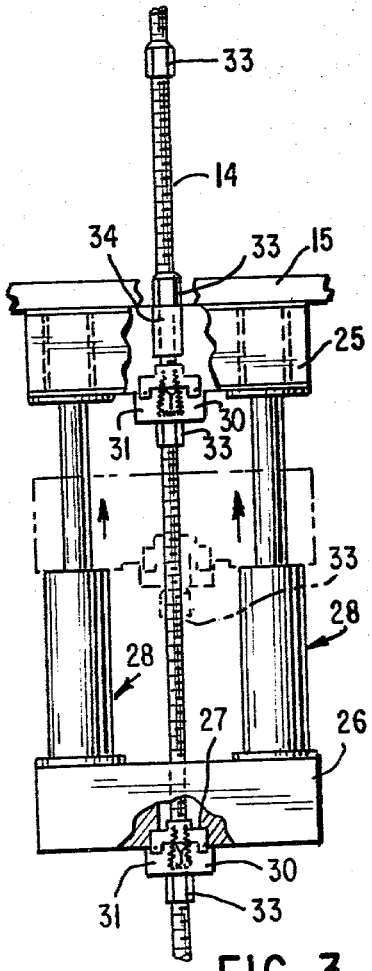
FIG. 3 is a side elevation illustrating a first climbing step in the use of the jacking device.

More specifically, as shown in FIG. 3, each jacking device includes an upper yoke frame 25 and a lower yoke frame 26. The yoke frames define vertical openings 27 which are transversely larger than the connectors 24 and nuts 23 so as to permit free movement of the yoke frames about the connectors and nuts.

Figure 2:
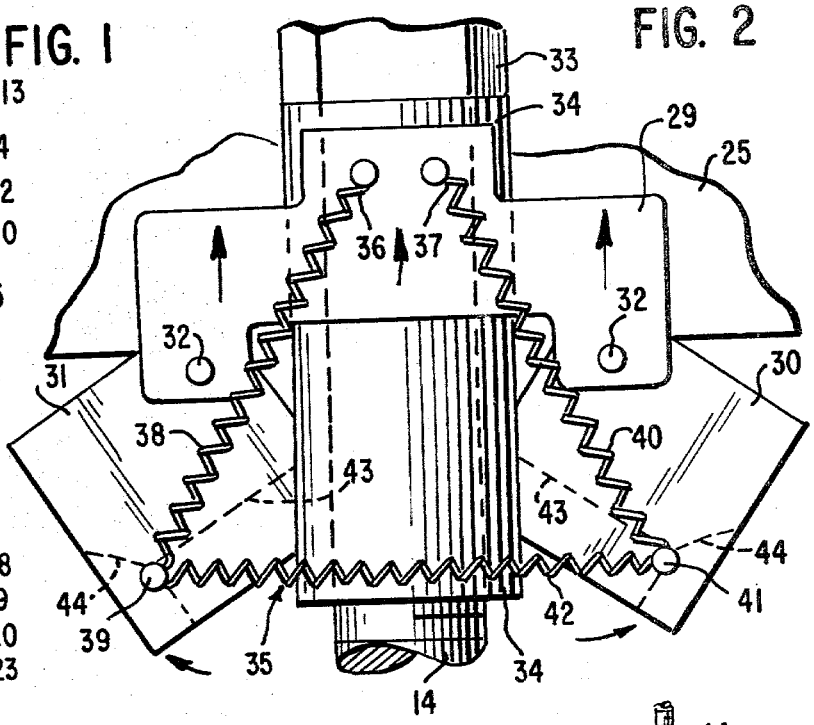
FIG. 2 is a fragmentary enlarged elevation illustrating the spring-loaded chuck assembly of the jacking device.

Upper yoke frame 25 is connected to lower yoke frame 26 by a pair of extensible devices 28 which, illustratively, may comprise hydraulic rams, the operation of which may be controlled from the hydraulic pump means 17. The extensible devices may be operated to effect variable spacing between the yoke frames 25 and 26 to effect the desired relative movement between the respective jacking devices 10 and the connectors 34 and nuts 33. As shown in FIG. 2, the yoke frame is provided with a carrier 29 to which a pair of chucks 30 and 31 are pivotally connected as by pivots 32. As shown in FIG. 2, the chucks may pivot to an outer position, permitting the connector 34 and nut 33 to pass therebetween as a result of relative movement of the jacking device and thread bar.

As further shown in FIG. 2, the chucks are biased toward the axis of the thread bar by a novel biasing means 35 comprising a coil spring having its ends 36 and 37 connected to the carrier 29. One end portion 38 of the spring extends from end 36 to a spring retainer 39 on chuck 31 and the other end portion 40 of the spring extends from the end 37 to a similar retainer 41 on chuck 30. The midportion 42 of the spring extends between retainers 39 and 41 and serves to bias the chucks toward the thread bar 14, as shown in FIG. 2. The end portions 38 and 40 of the spring serve to swing the chucks 30 and 31 upwardly into embracing relationship with the thread bar when the chucks are disposed clear of either connector 34 or nut 33, as illustrated in FIGS. 3, 4 and 5.

As further shown in FIG. 2, each of the chucks defines an inner, semicylindrical recess 43 adapted to embrace the thread bar 14 when the chucks are swung inwardly by the spring means 35 free of the connectors 34 and nuts 33.

Figure 4:
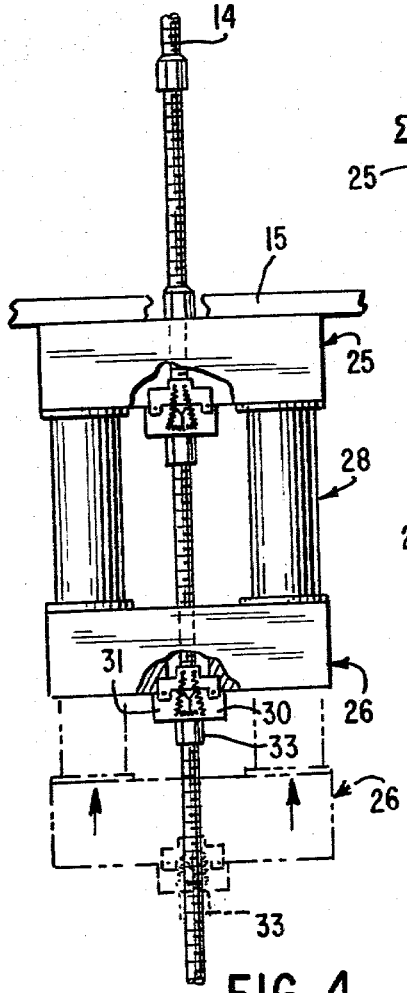
FIG. 4 is an elevation illustrating a second step therein.
Figure 5:
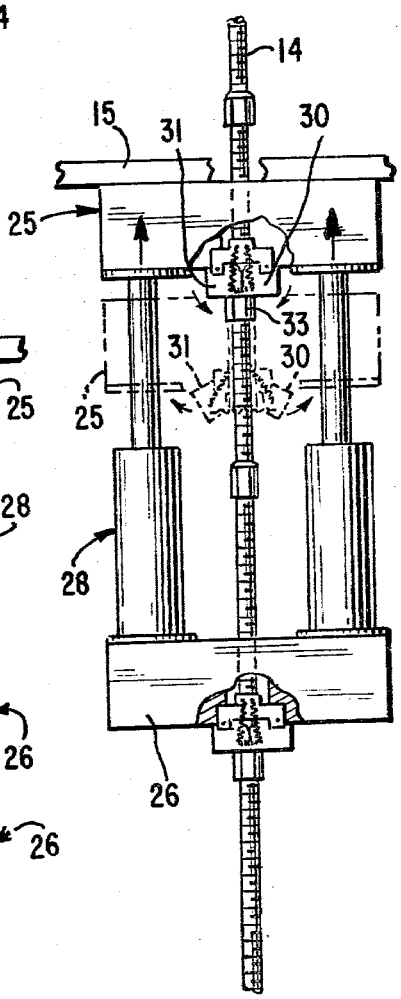
FIG. 5 is an elevation illustrating a third step therein.

The lower end of the recesses 43 may define furstoconical surfaces adapted to have complementary fit with the upper surfaces of the nuts 33, which may be recessed therein when the chucks are in supportive engagement with the nuts, as illustrated in FIGS. 3, 4 and 5.

The jacking device 10 may include a pair of carriers 29 at opposite sides of the chucks 30 and 31, with the pivot pins 32 extending between the paired carriers and through the chucks, as illustrated in FIG. 2. The carriers are spaced sufficiently to provide the desired clearance of the connectors 34 and nuts 33, as discussed above.

INDUSTRIAL APPLICABILITY

The operation of the jacking device may best be understood by reference to FIGS. 3, 4 and 5, successively. As shown in FIG. 3, the lower yoke frame may be supported on the lowermost nut 33 by the engagement of the chucks 30 and 31 thereon with the top of the nut. Operation of the extensible means 28 may be effected to urge the upper yoke frame 25 upwardly from the broken line position in FIG. 3 to the full line position therein. As shown in FIG. 3, in the upper position of the yoke frame 25, the yoke frame has moved into surrounding relationship to the connector 34. As further illustrated in FIG. 3, the nut 33 previously supporting the upper yoke frame 25 has been threaded upwardly from its previous position into underlying supporting relationship to the chucks 30 and 31 of the upper yoke frame 25. Thus, the upper yoke frame is now effectively supported on the thread bar 14.

Referring now to FIG. 4, the extensible devices 28 may now be retracted so as to pull the lower yoke frame 26 upwardly away from the lowermost nut 33 from the broken line position therein to the full line position. The nut is then hand-threaded up to the full line position thereof subjacent the lower yoke frame 26 for engagement with the chucks 30 and 31 thereof, whereby the lower yoke frame is now supported on the thread bar 14.

Referring now to FIG. 5, re-extension of the extensible devices 28 now lifts the upper yoke frame 25 from the broken line position in FIG. 5 to the full line position therein. In moving upwardly, the upper yoke frame moves past the connector 34 and the overlying nut 33. Such movement is permitted by the outward swinging of the chucks 30 and 31, as shown in broken lines in FIG. 5. The chucks are automatically swung outwardly by the engagement thereof with the lower end of the connector 34 and, thus, elevation of the upper yoke frame 25 is unimpeded.

Once the chucks clear the top of the superjacent nut 33, they may swing in under the biasing action of spring 25 to the full line position thereof, as shown in FIG. 5. Nut 33 may be then hand-threaded upwardly into engagement with the bottom of the chucks, whereby the upper yoke frame 25 is now supported on the thread bar 14, completing one step in the jacking operation.

The jacking steps may be repeated as desired to effect the desired overall lifting of the load. As discussed above, while the load 15 is illustrated in FIGS. 3, 4 and 5 as being carried on the upper portion of yoke frame 25, the invention is equally adaptable for use wherein the jacking device is secured and the thread bar moves upwardly therethrough by a similar series of relative movements of the yoke frames 25 and 26 toward and from each other.

In the illustrated embodiment utilizing thread bars in the range of $\frac{5}{8}''$ diameter to $1\frac{3}{8}''$ diameter, loads of 45,000 lbs. may be lifted by means of the jacking devices 10 with a safety factor of 4 to 1. The jacking devices are adapted for use with any one of a wide range of different diameter thread bars by suitable facilitated substitution of different size chucks 30 and 31, as will be obvious to those skilled in the art.

In one jacking device embodying the invention, the jacking device structure was shown to be stronger than the thread bars, lift nuts and couplers.

As a result of the automatic clearance of the chucks relative to elements on the thread bars, such as the couplers 34 and nuts 33, when relative movement is effected to cause movement thereof through the jacking devices, a substantially simplified and cost-saving construction operation is provided. Not only is a substantial saving in man hours realized, but also improved safety in the use of the jacking device is obtained. The structure of the chucks as discussed above provides further improved safety in effectively preventing lateral movement thereof during the jacking operation.

As the jacking device is adapted for use in climbing the thread bar, need to disassemble the coupled bars during the jacking operation, as is required in the prior art structures, is effectively eliminated, further reducing the man hours involved in the jacking operation. By permitting the alternative pulling of the thread bar in lifting the load, the present jacking device provides further improved versatility and usefulness.

The foregoing disclosure of specific embodiments is illustrative of the broad inventive concepts comprehended by the invention.

I claim:

1. In an apparatus for selectively raising a load relative to a vertical thread bar having a plurality of vertically spaced threaded elements thereon, the apparatus including an upper support defining a vertical through opening for relative movement therethrough of said bar and threaded elements thereon, a lower support defining a vertical opening for relative movement therethrough of said bar and threaded elements thereon, and extensible means for moving said support longitudinally of said bar selectively toward and from each other, the improvement comprising:

first stop means;

means for pivotally carrying the first stop means on the upper support to be selectively positioned in a first, inner position wherein the stop extends to closely adjacent the bar, and in a second, outer position spaced from the bar to permit movement of the upper support upwardly past a next superior threaded element to dispose the stop means superjacent the passed stop;

first spring means for biasing said stop means pivotally toward said first position;

second stop means;

means for pivotally carrying the second stop means on the lower support to be selectively positioned in a first, inner position wherein the second stop means extends to closely adjacent the bar, and in a second, outer position spaced from the bar to permit movement of the lower support upwardly past a next superior threaded element to dispose the second stop means superjacent the passed threaded element; and second spring means for biasing the second stop means pivotally toward said first position thereof, said stop means defining bottom surfaces arranged in said first position thereof to be supported by the passed threaded elements as a result of threaded movement of the passed threaded elements upwardly into engagement therewith.

2. The load raising apparatus of claim 1 wherein said means for movably carrying the stop means on said supports comprise pivot means.

3. In an apparatus for selectively raising a load relative to a vertical thread bar having a plurality of vertically spaced threaded elements thereon, the apparatus including an upper support defining a vertical through opening for relative movement therethrough of said bar and threaded elements thereon, a lower support defining a vertical opening for relative movement therethrough of said bar and threaded elements thereon, and extensible means for moving said support longitudinally of said bar selectively toward and from each other, the improvement comprising:

first stop means;

means for movably carrying the first stop means on the upper support to be selectively positioned in a first, inner position wherein the stop extends to closely adjacent the bar, and in a second, outer position spaced from the bar to permit movement of the upper support upwardly past a next superior threaded element to dispose the stop means superjacent the passed stop;

means for biasing said stop means toward said first position;

second stop means;

means for movably carrying the second stop means on the lower support to be selectively positioned in a first, inner position wherein the second stop means extends to closely adjacent the bar, and in a second, outer position spaced from the bar to permit movement of the lower support upwardly past a next superior threaded element to dispose the second stop means superjacent the passed threaded element; and means for biasing the second stop means toward said first position thereof, said stop means defining bottom surfaces arranged in said first position thereof to be supported by the passed threaded elements as a result of threaded movement of the passed threaded elements upwardly into engagement therewith, said stop means defining angled top surfaces adjacent said bar for camming each stop means outwardly away from said bar as an incident of movement of the stop means upwardly against and past said next superior threaded element.

4. The load raising apparatus of claim 1 wherein each said stop means comprises a pair of chucks at opposite sides of the bar.

5. The load raising apparatus of claim 1 wherein said supports define shoulders for limiting the inward movement of the stop means to said first position.

6. In an apparatus for selectively raising a load relative to a vertical thread bar having a plurality of vertically spaced threaded elements thereon, the apparatus including an upper support defining a vertical through opening for relative movement therethrough of said bar and threaded elements thereon, a lower support defining a vertical opening for relative movement therethrough of said bar and threaded elements thereon, and extensible means for moving said support longitudinally of said bar selectively toward and from each other, the improvement comprising:

first stop means;

means for movably carrying the first stop means on the upper support to be selectively positioned in a first, inner position wherein the stop extends to closely adjacent the bar, and in a second, outer position spaced from the bar to permit movement of the upper support upwardly past a next superior threaded element to dispose the stop means superjacent the passed stop;

means for biasing said stop means toward said first position;

second stop means;

means for movably carrying the second stop means on the lower support to be selectively positioned in a first, inner position wherein the second stop means extends to closely adjacent the bar, and in a second, outer position spaced from the bar to permit movement of the lower support upwardly past a next superior threaded element to dispose the second stop means superjacent the passed threaded element; and means for biasing the second stop means toward said first position thereof, said stop means defining bottom surfaces arranged in said first position thereof to be supported by the passed threaded elements as a result of threaded movement of the passed threaded elements upwardly into engagement therewith, said biasing means including first spring means urging said stop means inwardly transversely toward the bar and second spring means urging said stop means upwardly lengthwise of the bar.

7. In an apparatus for selectively raising a load relative to a vertical thread bar having a plurality of vertically spaced threaded elements thereon, the apparatus including an upper support defining a vertical through opening for relative movement therethrough of said bar and threaded elements thereon, a lower support defining a vertical opening for relative movement therethrough of said bar and threaded elements thereon, and extensible means for moving said support longitudinally of said bar selectively toward and from each other, the improvement comprising:

first stop means;

means for movably carrying the first stop means on the upper support to be selectively positioned in a first, inner position wherein the stop extends to closely adjacent the bar, and in a second, outer position spaced from the bar to permit movement of the upper support upwardly past a next superior threaded element to dispose the stop means superjacent the passed stop;

means for biasing said stop means toward said first position;

second stop means;

means for movably carrying the second stop means on the lower support to be selectively positioned in a first, inner position wherein the second stop means extends to closely adjacent the bar, and in a second, outer position spaced from the bar to permit movement of the lower support upwardly past a next superior threaded element to dispose the second stop means superjacent the passed threaded element; and means for biasing the second stop means toward said first position thereof, said stop means defining bottom surfaces arranged in said first position thereof to be supported by the passed threaded elements as a result of threaded movement of the passed threaded elements upwardly into engagement therewith, said stop means comprising a pair of chucks, said means for movably carrying the stop means comprise pivot means permitting mounting the chucks to the support one each at opposite sides of the bar, and said biasing means comprises spring means extending between said chucks for urging said chucks toward the bar therebetween.

8. The load raising apparatus of claim 7 wherein said spring means comprises a spring having end portions connected to the support and a midportion connected to said chucks for urging said chucks toward the bar therebetween.

9. The load raising apparatus of claim 7 wherein said spring means comprises a spring having end portions connected to the support and a midportion connected to said chucks for urging said chucks toward the bar therebetween, the end portions of the spring extending upwardly from the opposite ends of the midportion to urge the chucks pivotally upwardly lengthwise of the bar.

10. In an apparatus for selectively raising a load relative to a vertical thread bar having a plurality of vertically spaced threaded elements thereon, the apparatus including an upper support defining a vertical through opening for relative movement therethrough of said bar and threaded elements thereon, a lower support defining a vertical opening for relative movement therethrough of said bar and threaded elements thereon, and extensible means for moving said support longitudinally of said bar selectively toward and from each other, the improvement comprising:

first stop means;

means for movably carrying the first stop means on the upper support to be selectively positioned in a first, inner position wherein the stop extends to closely adjacent the bar, and in a second, outer position spaced from the bar to permit movement of the upper support upwardly past a next superior threaded element to dispose the stop means superjacent the passed stop;

means for biasing said stop means toward said first position;

second stop means;

means for movably carrying the second stop means on the lower support to be selectively positioned in a first, inner position wherein the second stop means extends to closely adjacent the bar, and in a second, outer position spaced from the bar to permit movement of the lower support upwardly past a next superior threaded element to dispose the second stop means superjacent the passed threaded element; and means for biasing the second stop means toward said first position thereof, said stop means defining bottom surfaces arranged in said first position thereof to be supported by the passed threaded elements as a result of threaded movement of the passed threaded elements upwardly into engagement therewith, the upper end of the threaded elements being frustoconical and the stop means defining a complementary lower frustoconical surface engaged by the threaded element upper end when the support is carried on the threaded element as a result of upward threaded movement of the threaded element into engagement with the stop means.

11. In an apparatus for selectively raising a load relative to a vertical thread bar having a plurality of vertically spaced threaded elements thereon, the apparatus including a plurality of supports each defining a vertical through opening for relative movement therethrough of said bar and threaded elements thereon, the improvement comprising:

a pair of chucks;

means for pivotally carrying the chucks on said support to be selectively positioned in a first, inner position wherein the chucks extend to closely adjacent the bar, and in a second, outer position spaced from the bar to permit movement of the support upwardly past a next superior threaded element to dispose the chucks superjacent the passed stop; and spring means extending between said chucks for biasing said chucks pivotally toward said first position.

12. In an apparatus for selectively raising a load relative to a vertical thread bar having a plurality of vertically spaced threaded elements thereon, the apparatus including a plurality of supports each defining a vertical through opening for relative movement therethrough of said bar and threaded elements thereon, the improvement comprising:

a pair of chucks;

means for movably carrying the chucks on said support to be selectively positioned in a first, inner position wherein the chucks extend to closely adjacent the bar, and in a second, outer position spaced from the bar to permit movement of the support upwardly past a next superior threaded element to dispose the chucks superjacent the passed stop; and means for biasing said chucks toward said first position, said chucks defining angled top surfaces adjacent said bar for camming each chuck outwardly away from said bar as an incident of movement of the chucks upwardly against and past said next superior threaded element.

13. The load raising apparatus of claim 11 wherein said support defines shoulders for limiting the inward movement of the chucks to said first position.

14. In an apparatus for selectively raising a load relative to a vertical thread bar having a plurality of vertically spaced threaded elements thereon, the apparatus including a plurality of supports each defining a vertical through opening for relative movement therethrough of said bar and threaded elements thereon, the improvement comprising:

a pair of chucks;

means for movably carrying the chucks on said support to be selectively positioned in a first, inner position wherein the chucks extend to closely adjacent the bar, and in a second, outer position spaced from the bar to permit movement of the support upwardly past a next superior threaded element to dispose the chucks superjacent the passed stop; and means for biasing said chucks toward said first position, said biasing means including first spring means urging said chucks generally transversely toward the bar and second spring means urging said chucks generally lengthwise of the bar.

* * * * *